United States Patent [19]

Guise

[11] 4,071,313

[45] Jan. 31, 1978

[54] POLYUREA POLYCARBAMOYL SULPHONATES

[75] Inventor: Geoffrey Bruce Guise, Highton, Australia

[73] Assignee: Commonwealth Scientific and Industrial Research Organization, Campbell, Australia

[21] Appl. No.: 746,730

[22] Filed: Dec. 2, 1976

[30] Foreign Application Priority Data

Dec. 5, 1975 Australia ..... 4204/75

[51] Int. Cl.[2] ..... D06M 15/52; C08L 81/08

[52] U.S. Cl. ..... 8/127.6; 8/128 A; 8/181; 8/192

[58] Field of Search ..... 8/127.6, 181, 192, 128 A, 8/195, DIG. 11; 260/77.5 A, 77.5 CH, 18 TN

[56] References Cited

U.S. PATENT DOCUMENTS

| | | | |
|---|---|---|---|
| 3,687,605 | 8/1972 | Farmer | 8/127.6 |
| 3,801,272 | 4/1974 | Wagner et al. | 8/127.6 |
| 3,854,873 | 12/1974 | Reid et al. | 8/187 |

OTHER PUBLICATIONS

Polycarbamoyl sulphonates; G. B. Guise et al, JSDC, July 1976.

*Primary Examiner*—John Kight, III
*Attorney, Agent, or Firm*—Dennis P. Clarke

[57] ABSTRACT

A composition for the treatment of fibrous materials which has the average molecular formula represented by the structure (I), $$R(NHCONR'R'')_x(NHCOSO_3^-M^+)_Y \quad (I)$$

where R is an organic radical, containing at least 6 carbon atoms; R′ is an alkyl or aryl radical which may or may not contain substituents; R″ is either hydrogen or an alkyl radical; $x$ and $y$ are each greater than zero and $x + y \geqq 2$; $M^+$ is a monovalent cation or one equivalent of a polyvalent cation such that there is electrical neutrality in the molecule; and the molecular weight, as represented by the formula (I), is in excess of 500.

17 Claims, No Drawings

POLYUREA POLYCARBAMOYL SULPHONATES

The present invention provides novel compounds and processes for their preparation. These compounds contain both substituted ureas and carbamoyl sulphonate salt groups (i.e., $—NHCOSO_3^-$) and have been found to be particularly suited to the treatment of fibrous materials when used alone or in admixture with other compounds.

In our Australian Pat. No. 460,168, novel methods were described to prepare compounds with two or more carbamoyl sulphonate salt groups, i.e., polycarbamoyl sulphonates (for which the abbreviation PCS will be used hereafter). It was also found that such PCS were advantageous for the treatment of fibrous materials, in particular, for imparting a high level of shrink-resistance to wool fabrics. In our subsequent Australian applications 67,877/74, 76753/75 and 78235/75, further advantageous compositions containing PCS, and the use of such compositions to treat fibrous materials, were described.

We have now found that, if compounds containing carbamoyl sulphonate groups contain in addition certain di or tri substituted urea groups, they show improved properties when compared with the previously mentioned PCS, particularly when used to treat fibrous materials. Such compounds will hereafter be referred to as polyurea polycarbamoyl sulphonates using the abbreviation PPS.

Accordingly, the present invention thus provides a composition which has the average molecular formula represented by the structure (I), $$R(NHCONR'R^{11''})_x(NHCOSO_3^-M^+)_y \qquad (I)$$

where R is an organic radical, containing at least 6 carbon atoms; R′ is an alkyl or aryl radical which may be or may not contain substituents; R″ is either hydrogen or an alkyl radical; $x$ and $y$ are each greater than zero and $x + y \geqq 2$; $M^+$ is a monovalent cation (usually sodium) or one equivalent of a polyvalent cation such that there is electrical neutrality in the molecule; and the molecular weight, as represented by the formula (I), is in excess of 500.

It is to be appreciated that formula (I) represents an average structure only and individual molecular species may be present which have more or less urea and/or carbamoyl sulphonate groups than the average. It is possible to prepare compositions of the average formula (I) by physically mixing I ($x=0$) and I ($y=0$) however such compositions differ significantly from those prepared by the methods of the present invention and do not possess the same advantageous properties. For example I ($y=0$) will be water insoluble unless R contains solubilizing groups whereas I ($x=0$) (as described in our Australian patent No. 460,168) are fully water soluble. Thus the physical mixture will only contain a proportion of water soluble material, In contrast the I prepared by the methods of the present invention are essentially fully water soluble or form stable dispersions on dilution with water.

Accordingly, the present invention provides a method to prepare the composition I (as defined above) in a single synthetic operation in which a polyisocyanate (A) is allowed to react simultaneously or successively with reactants (B) and (C) in solvent (D), the components A, B, C and D being defined as follows:

Polyisocyanate A is a compound or mixture of compounds containing an average two or more isocyanate groups attached to carbon atoms. Component B is a compound or mixture of compounds containing an average one or more primary and/or secondary amino groups per molecule. The reaction of the amino groups of component B with some of the isocyanate groups of A forms substituted ureas as shown in equation II.

$$R^1NCO + R^2R^3NH \rightarrow R^1NHCONR^2R^3 \qquad (II)$$

where $R^1$, $R^2$ and $R^3$ are suitable organic radicals.

Component C is an aqueous solution containing one or more of the following types of ions, metabisulphite, bisulphite or sulphite. The reaction between component C and some of the isocyanate groups of A produces carbamoyl sulphonate groups as shown in equation III.

$$R^4NCO + HSO_3^- \rightarrow R^4NHCOSO_3^- \qquad (III)$$

where $R^4$ is an organic radical.

Solvent D comprises 75 % or more by weight of one or more water miscible aliphatic compounds containing alcohol and/or ether groups. The proportions of components A, B and C are chosen such that for each mole of isocyanate groups in A there is a total in B and C of at least one mole of amino groups and bisulphite ions or their equivalents). The proportions of component D and water in component C are preferably such that the PPS formed, contains more than 10% solids by weight and most preferably more than 20%. It is desirable to produce directly concentrated PPS solutions which can be used directly, rather than to form dilute solutions which may require concentrations to be industrially useful.

It was somewhat unexpected that the reaction of A, B, C and D did in fact produce PPS of structure (I) in view of the known ease with which isocyanate groups react with alcohols and water. In spite of this it was found that the majority of the isocyanate groups of A underwent reactions II or III.

It is to be appreciated that PPS of structure (I) may be obtained by other means, for example by performing reactions II and III in separate operations or by converting all the isocyanate groups of A into carbamoyl sulphonates and then converting some of these into substituted urea according to reaction IV.

$$R^1NHCOSO_3^- + R^2R^3NH \rightarrow R^1NHCONR^2R^3 + HSO_3^- \qquad (IV)$$

However, the preferred method of the present invention in which A, B, C and D react in one operation has advantages over these alternative synthetic routes. For example, it has been found that reaction IV will only proceed with strongly basic amines. Weakly basic amines, for example, those attached to aromatic rings, do not undergo this reaction at room temperature. Furthermore, by the method of the present invention it is possible to obtain PPS of structures which cannot be obtained by performing reactions II and III in separate operations. For example, in the case of aminophenols or diamines as component B, separate reaction with component A will probably result in reaction of all the amino groups as well as the phenols (due to the well known ease with which isocyanates react with amines or phenols) however, by the methods of the present invention it is possible to produce PPS in which only the amino group of the aminophenols has reacted with isocyanate groups or in which only one amino groups of the diamines have been converted into ureas. Such PPS containing free amino or phenolic groups have been found to possess advantageous properties for the treatment of textile materials.

A number of variations are possible in the reaction of components A, B, C and D including a. altering the relative proportions of A, B, C and D.

b. altering the mixing sequence of the four components.

c. changing the reaction temperature.

d. changing the relative proportions of the various ions in component C.

e. changing the composition of solvent D.

It is to be appreciated that by such variations it is possible to prepare a number of different PPS from a given component A and that these reactions in addition to forming PPS may form products of other structures. It is to be further appreciated that the PPS so produced from a given polyisocyanate may not be equally effective for the treatment of fibrous materials. It is preferable that the value of $y$ in structure I be such that the PPS is freely water soluble or is self-dispersible to give a stable dispersion or emulsion.

The preferred method for mixing the four components is to dissolve component A in solvent D and immediately or after a short delay to perform one of the following alternative steps:

1. adding a mixture of components B and C, or
2. adding components B and C simultaneously, or
3. adding component B and at a later stage adding component C, or
4. adding component C and at a later stage adding component B. In such sequences the component B may be added as such or in a solution in an organic solvent. Such sequences are preferably performed in the range 0° - 40° C and preferably in the range from 0° to 20° C.

The preferred class A polyisocyanates for the present invention have an average molecular weight in excess of 150. Suitable diisocyanates include those of structure $$OCN - (CH_2)_n - NCO$$

where $n$ is an integer from 2 to 16 but most preferably 4 or 6, i.e., tetramethylene diisocyanate and hexamethylene diisocyanate (such as the commercial product Desmodur H, Bayer), 1-isocyanato-3-isocyanatomethyl-3,5,5-trimethylcyclohexane (known commercially as isophorone diisocyanate), trimethylhexamethylene diisocyanate, 2-methoxycarbonylpentamethylenediisocyanate (known commercially as lysine diisocyanate), the isomeric diisocyanato-benzene, xylene, napthalenes, chlorobenzenes, bromobenzenes and the like, the isomeric bisisocyanatomethyl-benzenes (i.e., xylylidene diisocyanates), diisocyanato-toluenes (particularly the 2,4- and 2,6-isomers or mixtures of these), the isomeric bis-(isocyanato) and bis-(isocyanato-methyl)-cyclohexanes, and methylcyclohexanes, the isomeric bis-(isocyanatocyclohexyl) methane (for example, the commercial products Nacconate H-12, Allied Chemicals, and Hylene W, du Pont, which are mainly the 4,4' isomer, diphenyl methane-b 4,4'-diisocyanate (known commercially as MDI, and this usually contains minor amounts of other isomers), dianisidine diisocyanate, diphenylene diisocyanate, bitolylene diisocyanate, and the commercial product DII (dimeryl diisocyanate (General Mills), which is a $C_{36}$-diisocyanate).

As examples of tri- and higher polyisocyanates these may be mentioned: triphenyl methane-4,4',4''-trisocyanate (sold commercially as Desmodur R (Bayer)), polymethylene polyphenylisocyanates (for example the commercial products of the PAPI series, Upjohn Co.), products containing isocyanate rings arising from the trimerisation of aromatic diisocyanates particularly 2,4- and 2,6-tolylene diisocyanate.

Further suitable higher molecular weight and/or functionality polyisocyanates for component A may be prepared by the reaction of one or more of the previously mentioned diisocyanates with polyols (i.e., compounds containing on average two or more hydroxyl groups per molecule, as in equation V.

$$R^6(OH)_n + n\ R^7(NCO)_2 \rightarrow R^6(OCONHR^7NCO)_n \qquad V$$

where $R^6$ and $R^7$ are suitable organic radicals. The stoichiometry may be varied from that shown in equation V, provided that the products contain on average at least two isocyanate groups. Such polyisocyanates preferably have a molecular weight in the range 500 to 5000.

For the preparation of polyisocyanates from diisocyanates and polyols, suitable polyols include those from the polymerisation of cyclic ethers, for example, ethylene oxide, propylene oxide or tetrahydrofuran alone or in mixtures or in the presence of polyfunctional initiators, for example, glycerol or trimethylolpropane. Particular examples of such polyols include polypropylene oxide diols and triols with average molecular weights from 500 to 5000, and polyoxytetramethylene glycols. Other suitable polyols include polycaprolactone polyols, hydroxyl terminated polybutadiene, butadiene-styrene, or butadiene-acrylonitrile copolymers, castor oil and other glycerides of hydroxyacids, polymerised castor oils, the reaction products of ethylene oxide or propylene oxide and castor oil and the like. Polyols with a polyester bakebone can be obtained from the reaction of dicarboxylic acids with a slight excess of diol, for example, ethylene glycol, 1,4-butandiol or a triol, for example, glycerol, trimethyol propane. Further suitable polyols include glycerol, trimethylolpropane, trimethylol ethane, pentaerythritol and dipentaerythritol.

Suitable amino compounds for class B of the present invention have one or more amino groups of the type $R^8NH_2$ or $R^9R^{10}NH$ where $R^9$ is an organic radical and $R^{10}$ is either an organic or inorganic radical, and include the following classes:

1. Primary and secondary aliphatic amines.
2. Primary and secondary aromatic or heteroaromatic amines. The aromatic rings may contain additional substituents, for example, aminophenols.
3. Hydroxylamines of the type $R'ONH_2$, HO-NHR' and R'ONHR'', mono, di and tri-substituted hydrazines, N-chloroamines, N-substituted sulphamic acids, N-substituted hydroxylamine-O-sulphonic acid and the like.
4. Compounds containing two or more primary and/or secondary aliphatic amino groups, for example, diamines of the type $NH_2(CH_2)_n\ NH_2$ when $n$ is 2 or greater, the commercial product Dimer Diamine (General Mills), which is a $C_{36}$ diamine prepared from "dimer acid", i.e., dimerized natural fatty acids.
5. Diamines of the type $R^{11}NHCH_2CH_2CH_2NH_2$ where $R^{11}$ is an organic radical which are prepared from primary amines by reaction with acrylonitrile, followed by reduction of the resultant nitrile.

6. Aromatic diamines, for example, the isomeric phenylene diamines, substituted phenylene diamines and naphthylene diamines.

7. Amino terminated polyethers, particularly those derived from the polymerisation of propylene oxide and/or ethylene oxide. For example, 2-aminoethyl and 2-aminopropyl ethers of polypropylene oxide diols or triols, or ethylene oxide propylene oxide, copolymer diols or triols. Commercial examples of such products include Jeffamine D-230, D-400, D-1000, D-2000 and T-403 (Jefferson Chemical) (2-aminopropylethers of polypropylene oxide diols and triols), Jeffamine ED-600, ED-900 and ED-2001 (2-aminopropyl ethers of ethyleneoxide - propylene oxide copolymers). Further products of this type are discussed in U.S. Pat. Nos. 3,236,895 and 3,462,393. Furthermore, a mixture of more than one compound of one or more of the above-mentioned types of amines may also be used.

The preferred component C for the present invention which contain bisulphite ions, are solutions prepared by dissolving in water sodium, potassium, lithium and/or ammonium bisulphites and/or metabisulphites. Such solutions may also be prepared by passing sulphur dioxide into alkaline aqueous solutions, or by acidifying solutions of sulphite salts. Alternatively, such solutions may be obtained from the adducts of aldehydes and ketones with alkali metal bisulphites. The most preferred solution (d) is obtained by dissolving sodium metabisulphite in water. In the case of the isocyanate groups of A being attached to aromatic rings the preferred component C are aqueous solutions of mixtures of sodium metabisulphite and sodium sulphite or aqueous solutions of sodium metabisulphite containing tertiary amines.

The preferred solvents D for the purposes of the present invention contain 75% or more by weight of one or more of the following : methanol, ethanol, n-propanol, iso-propanol, the isomeric butanols, tetrahydrofurfuryl alcohol, 2-methoxyethanol, and 2-ethoxyethanol, dioxan, tetrahydrofuran, ethylene glycol dimethyl ether, ethylene glycol diethyl ether, diethylene glycol dimethyl ether, and diethylene glycol diethyl ether. In addition, such solvents may contain water, water-miscible solvents, for example, acetone, dimethylformamide, dimethylsulphoxide and the like, or water-immiscible solvents, for example, ethyl acetate, aliphatic hydrocarbons, aromatic hydrocarbons, chlorinated hydrocarbons, esters and the like. The most preferred solvent D is ethanol, either in its pure form or in commercial grades where small amounts of water and/or methanol and/or denaturants may also be present.

It is to be also appreciated that the various components may have dissolved in them other materials, for example, inorganic salts, dyestuffs, agents to improve various textile properties, such as flame retardants, mothproofing agents, agents to impart and/or to stabilise creases, or products such as antioxidants, to modify the properties of the polymer formed on curing. Such additions are well known to those skilled in the polymer and textile arts.

The PPS prepared by the preferred processes of the present invention have been found to be particularly suited for the treatment of fibrous materials, for example, when applied and cured according to the methods of Australian Patent 460,168. It has also been found that compositions containing these PPS and other polymeric materials, especially latices of polyacrylic esters of dispersions of polymers containing a plurality of methane linkages, are also suited for the treatment of fibrous materials, for example, when applied and cured according to the methods of Australian Application No. 67877/74. As examples of such advantageous treatments of fibrous materials there may be mentioned the treatment of wool or wool blend fabrics to impart shrink resistance, the treatment of paper to improve the tear and wet strengths, the use of a binder for non-woven fibrous webs, the use as an adhesive for laminating fabrics or for binding flock fibers. The poly urea-carbamoyl sulphonates of the present invention may also have other advantageous applications, when used alone or in admixture with other polymers, for example, in surface coatings, for coating leather, binders for concrete and the like.

In addition to the above advantageous applications, the PPS may give improved results to the use of a compound containing only carbamoyl sulphonates, for example, PCS as prepared according to Australian Patent No. 460,168. The urea substituents may contain groups which may impart improved properties to the material produced by curing the PPS alone or in admixture with other polymeric materials. In this manner it is possible for example, to impart resistance to thermal and photodegradation (for example, by the use of aminophenols or phenylene diamines as component B), the ability to absorb light and to fluoresce, or to modify the physical properties of the cured material, or to change the solubility by incorporating cationic or anionic groups. It may also be possible to effect such improvements by adding various agents to PCS containing compositions. However, unlike the products of the present invention, such incorporated agents may not be covalently bound to the cured material and thus may be lost by various means, for example, during washing or dry cleaning. Such improvements are illustrated in the examples below.

In order to prepare a PCS suitable for the treatment of fibrous materials, two manufacturing steps are required. Firstly, reaction of a diisocyanate and polyol, and secondly, the reaction of the polyisocyanate formed with bisulphite. In contrast it is possible in one operation to prepare a PPS suitable for the treatment of fibrous materials by the use of a diisocyanate (such as hexamethylene diisocyanate or 2,4-tolylene diisocyanate) for component A and an amino-terminated polymer, particularly those with a polypropylene oxide or propylene oxide-ethylene oxide copolymer backbones for component B. Such simplification of manufacturing operations has obvious advantages.

In our copending Australian Application 87150/75 methods were described to prepare stable concentrated polymer mixtures from PCS and polyacrylic ester latices. The urea-carbamoyl sulphonates of the present invention have been found suitable for conversion to stable concentrated polymer mixtures according to the methods of our Australian Application 87150/75, and such mixtures have also been found to be particularly suited for the treatment of fibrous materials.

It is to be appreciated that many other modifications can be made to the processes described above, and that all such modifications are considered to be within the scope of this invention. The following examples are provided to illustrate the present invention but are not to be construed as limiting the invention in any way.

EXAMPLES

In the following examples percentages are by weight unless otherwise stated. The sodium metabisulphite used was found to be 95–97% pure by analysis. Polyisocyanate VI was prepared by heating dried polypropylene oxide triol, molecular weight 3000 (Desmophen 3400, Bayer) with one mole of hexamethylene diisocyanate (HDI) (Desmodur H, Bayer) per mole of hydroxyl groups at 110° for 2 hours under nitrogen. This gave a product, considered to have the idealized structure shown below, containing 3.5% isocyanate content.

$$CH_3CH_2C[CH_2(OCH_2-\overset{\overset{CH_3}{|}}{CH})_{16}OCONH(CH_2)_6NCO]_3 \qquad \text{(VI)}$$

Ethanol: The ethanol used in the following examples was F3 industrial methylated spirit from C.S.R. Pty. Ltd., and contained 95% ethanol, 2% methanol and water.

Carbamoyl Sulphonate Group Analysis: The extent of conversion of isocyanate groups into carbamoyl sulphonate groups was determined as follows: an aliquot (5 g) of the PPS preparation was weighed into a 250 ml conical flask and dissolved in water (75 ml) and isopropanol (100 ml). This was titrated against 0.05 M iodine solution containing potassium iodide to the iodine colour end-point. 30% w/v sodium hydroxide solution (10 ml) was added and then after 2–5 minutes the solution was acidified with 20% w/v sulphuric acid solution (25 ml) and immediately titrated again with 0.05 M iodinesolution. The first titre gives the free bisulphite content of the PPS and the second titre gives the carbamoyl sulphonate content.

Shrink Resist Effectiveness: To determine the effectiveness in shrink resisting wool fabrics, a sample of the PPS was diluted with 0.5% sodium bicarbonate solution to give a solution containing 4% polymer. This was then padded at 100% pick-up with a laboratory mangle onto plain weave worsted wool fabric (150 g/m$^2$). Samples were cured in a laboratory Conrad Peter Tenter for 5 minutes at 105° C. The area shrinkage was then measured on relaxed samples after a 6 hour wash in a 50l Cubex International Machine with 12.5 l wash liquor pH 7.5, 40° C using a load of 1 kg of samples and polyester weighting squares. The untreated fabric after this wash test shrank 70% in area whereas if effective, the treated samples shrank not more than 8% in area under these conditions.

Light Fastness: Samples as treated above for shrink-resist effectiveness were rinsed several times with distilled water at 20° C, dried at 50° C then exposed to sunlight under glass together with the I.S.O. Blue Standards. A rating of 4, for example, means that a sample exposed for a time longer than that required to develop appreciable fading in Blue Standard 4, when subsequently washed as above, showed more than 8% area shrinkage after a 6 hour wash test (as above).

Thermal Stability: Samples, as prepared for light fastness testing, were heated in an oven for 120°. If samples are heated for longer than the times quoted below, they showed more than 8% area shrinkage after a six hour wash test (as above).

EXAMPLE I

This example demonstrates the use of aminophenols as component B, to prepare PPS of structure (VII) from polyisocyanate VI.

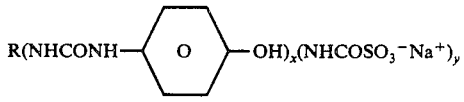

(VII)

To a well stirred 80% ethyl acetate solution of polyisocyanate VI (25 g), a solution of the aminophenol in ethanol (60 ml) was added. After 2 minutes a solution of sodium metabisulphite (2 g) in water (13 ml) was added. After a further 10 minutes stirring water (10 ml) was added to give a PPS solution of about 25% solids.

That PPS of structure VII were in fact produced in this reaction sequence was confirmed from the following experiments. If both the aminophenol and sodium metabisulphite were omitted; after 10 minutes in the reaction mixture more than 90% of the isocyanate groups remained. If the aminophenol was omitted after 10 minutes approximately 95% of the isocyanate groups were converted into carbamoyl sulphonates. If the sodium metabisulphite was omitted, after 2 minutes all the amino groups of the aminophenol had reacted. Little reaction was observed between phenol and VI in 10 minutes in the ethanol-water mixture used in the above reaction. These findings indicate the following order of reactivity toward the isocyanate groups of VI, amino > bisulphite >> water, ethanol or phenols. Therefore it seems most likely that PPS of structure VII were in fact produced.

Analysis of the carbamoyl sulphonate content of the PPS preparations was with 5% of the value expected from complete reaction of the isocyanate groups both with B and bisulphite. Samples of wool fabric were treated as above with the PPS and the area shrinkage, light fastness and thermal stability were determined. The results are shown in the table below. The percentage of isocyanate groups converted into ureas given in column 3 has been calculated assuming 100% reaction of the aminophenol.

To demonstrate that the improvement in thermal stability and light fastness was due to urea formation, to a sample of the PCS from experiment I above, p-amino phenol (0.2 mole per mole of carbamoyl sulphonate groups) was added and applied to wool. Such samples showed a light fastness of 6 and thermal stability of 30 mins. Repeated washing caused further reduction in light fastness and thermal stability to

TABLE I

| PPS Preparation No. | Component B | % of Isocyanate Groups Converted to Ureas | Area Shrink | Light Fastness | Thermal Stability |
|---|---|---|---|---|---|
| 1 | None | — | 0 | 4–5 | 10 min |
| 2 | p-aminophenol | 5 | 0 | 6 | 2 hrs |
| 3 | " | 10 | 0 | 7 | 4 hrs |
| 4 | " | 15 | 0 | 7–8 | 6 hrs |
| 5 | " | 20 | 0 | 8 | >16 hrs |
| 6 | " | 25 | 1 | >8 | >30 hrs |

TABLE I-continued

| PPS Preparation No. | Component B | % of Isocyanate Groups Converted to Ureas | Area Shrink | Light Fastness | Thermal Stability |
|---|---|---|---|---|---|
| 7 | o-aminophenol | 10 | 0 | 6 | 1½hrs |
| 8 | m-aminophenol | 10 | 1 | 7 | 1½hrs |
| 9 | 6-amino-3-methyl-phenyl | 10 | 0 | 7 | 2 hours |
| 10 | 4-amino-2,6-xylenol | 20 | 6 | 6–7 | 10 hrs |
| 11 | 2-amino-4-t-butyl-phenol | 20 | 1 | >7 | >16 hrs |

values similar to those obtained with the PCS from experiment I used alone. The PPS from experiments 2–11 showed no such reduction in light fastness or thermal stability on repeated washing.

In the following experiments the PCS of experiment 1 was mixed with the PPS from experiment 5 and applied to wool.

| Treatment | Light fastness | Thermal stability |
|---|---|---|
| 2% PCS-1 + 2% PPS-5 | 7–8 | 6 hrs |
| 3% PCS-1 + 1% PPS-5 | 7 | 4 hrs |
| 3.5% PCS-1 + 0.5% PPS-5 | 6 | 1 hr |

As a further demonstration that little reaction occurs between the carbamoyl sulphonate groups of the PCS from experiment 1 and aromatic amino groups, the PCS-1 was diluted with water to 5% solids and adjusted to pH 7 with disodium hydrogen phosphate. To this solution in separate experiments, one mole of the following amines per mole of carbamoyl were added, aniline, 2,4-dimethylaniline, and p-anisidine. After 48 hours at 20° C these solutions showed no appreciable reduction in carbamoyl sulphonate content. In contrast polyisocyanate VI reacted completely at 20° C with these amines within 2 minutes.

EXAMPLE II

This example demonstrates the use of diamines as component B to prepare PPS of structure VIII in which on average only one of the amino groups of the diamine have reacted.

$$R(NHCONHR^1NH_2)_x(NHCOSO_3^-Na^+)_y \qquad \text{(VIII)}$$

The preferred method to prepare PPS of structure VIII depends on relative reactivity of the amino groups of the diamine and bisulphite with the isocyanate groups of component A. Case 1: Both the amino groups of the diamine react more rapidly with the isocyanate groups of component A than bisulphite reacts. Thus if the diamine and bisulphite are added simultaneously or the bisulphite is added after the diamine, a PPS will be formed in which essentially all the amino groups of the diamine have reacted. To obtain a PPS containing free amino groups it is necessary to first react polyisocyanate with bisulphite and then at a point when some isocyanate groups remain an excess of diamine is added. The preferred method is to react each mole of isocyanate groups with $x$ moles of bisulphite (where $x < 1$) and when this has reacted add 1-x moles of diamine.

To an 80% ethyl acetate solution of polyisocyanate VI (25 g) in ethanol (40 ml) a solution of sodium metabisulphite (sufficient to react 80% of the isocyanate groups) in water (15 ml) was added. After 10 minutes a solution of the diamine (0.2 moles per mole of isocyanate groups) in ethanol (20 ml) was added.

The PPS solutions were applied to wool and the light fastness and thermal stability determined as above.

| Diamine | Light Fastness | Thermal Stability |
|---|---|---|
| o-phenylenediamine | >6 | 1½ hrs |
| m-phenylenediamine | >7 | 1½ hrs |
| p-phenylenediamine | >7 | 1½ hrs |
| 2,4-diaminotoluene | >7 | 1½ hrs |
| 2,6-diaminotoluene | >7 | 1½ hrs |
| 3,4-diaminotoluene | >6 | 1½ hrs |
| 4,4'-diaminodiphenylmethane | >6 | 15 min |
| o-tolidine | 4–5 | 1½ hrs |
| N-methyl-4'-aminobenzylamine | >6 | 1½ hrs |
| 4,5-dimethyl-o-phenylenediamine | >6 | 1½ hrs |

Case 2: The amino groups of the diamine have equal or similar reactivity but react much more slowly than in Case 1. In this situation the component A can be reacted (as in Example I) with the diamine and when approximately 50% of the amino groups have reacted bisulphite is added. Alternatively the method in case 1 can be used to prepare PPS of structure VIII.

In the following examples the method of case 1 was used.

| Diamine | Light Fastness | Thermal Stability |
|---|---|---|
| 4,4'-diaminodiphenylsulphone | 6 | 15 min |
| 1,2-dianilinoethane | 6 | 1½ hrs |
| 2,6-dichloro-p-phenylenediamine | 7 | 6 hrs |

Similar results were obtained when the method of example I was used with the diamines. The method of example I with the following diamines gave the following results.

| Diamine | Delay before Addition of Bisulphite | Light Fastness | Thermal Stability |
|---|---|---|---|
| o-dianisidine | 30 sec | 5 | 4 hrs |
| Tenamine 4 (Eastman Kodak) | 30 sec | >7 | 4 days |
| 4,5-dimethyl-o-phenylene diamine | 30 sec | >6 | 1½ hrs |

Case 3: One of the amino groups of the diamine reacts with isocyanates much faster than bisulphite reacts whilst the other reacts slower than bisulphite. In this case, the method of example I can be used to prepare PPS of structure VIII, i.e., the diamine is added to the polyisocyanate A. At the same time, or after a slight delay, bisulphite is added.

To a well stirred 80% ethyl acetate solution of polyisocyanate VI (25 g) a solution of the diamine (0.2 moles per mole of isocyanate groups) was added. After 2 minutes a solution of sodium metabisulphite (2 g) in water (13 ml) was added. After 10 minutes the solution diluted with water to 25% solids content. Fabric samples were treated as above, the light fastness and thermal stabilities were determined giving the following results.

| Diamine | Light Fastness | Thermal Stability |
|---|---|---|
| 2-chloro-p-phenylenediamine | 7 | 6 hrs |
| Phenyl hydrazine | >7 | 6 hrs |
| p-aminodiphenylamine | 6 | >4 days |

Case 4: Both of the amino groups react with the isocyanate groups of component A more slowly than bisulphite. In this situation side reactions of the isocyanate groups with water or the alcohol groups of the solvent become pronounced and it is usually not possible to prepare PPS of structure VIII. An example of such a diamine is 1-chloro-2,4-diamino-4-methylsulphonylbenzene.

EXAMPLE III

In this example amino terminated polyethers are allowed to react in ethanol with low molecular weight di- and poly-isocyanates, and then an aqueous bisulphite solution is added. In this manner higher molecular weight PPS are formed in one operation.

The polyamine was dissolved in the alcohol by stirring and then the polyisocyanate was added. As this reaction was exothermic it was preferable to cool the reaction mixture. After a delay of 1–2 minutes an aqueous solution of sodium bisulphite was added. The following table gives some examples of PPS prepared in this manner. In each case further addition of ethanol after completion of the reaction resulted in precipitation of the PPS as a white solid.

Some examples of such preparations are given in the following table.

| No. | Polyamine | Solvent | Polyisocyanate | Water | Sodium Metabisulphite |
|---|---|---|---|---|---|
| 1 | Jeffamine D-400(2g) | Ethanol (150 ml) | Desmodur N (7.5g) | 20 ml | 3.5g |
| 2 | Jeffamine D-400(4g) | Ethanol (135 ml) | Desmodur N (7.5g) | 20 ml | 2.5g |
| 3 | Jeffamine ED900(4.5g) | Ethanol (100 ml) | Desmodur N (7.5g) | 15 ml | 3.5g |
| 4 | Jeffamine ED900(9g) | Ethanol (130 ml) | Desmodur N (7.5g) | 20 ml | 2.5g |
| 5 | Jeffamine D230(4.6g) | Ethanol (100 ml) | HDI (6.5ml) | 25 ml | 4.2g |
| 6 | Jeffamine D400(8g) | Ethanol (75 ml) | HDI (6.5ml) | 20 ml | 4.2g |
| 7 | Jeffamine T403(8g) | Ethanol (100 ml) | HDI (8.5ml) | 25 ml | 6.2g |
| 8 | Jeffamine ED600(10g) | Ethanol (75 ml) | HDI (6.5ml) | 20 ml | 4.2g |
| 9 | Jeffamine ED900(11g) | Ethanol (100 ml) | HDI (4 ml) | 20 ml | 4g |
| 10 | Jeffamine D400(4g) | Isopropanol (100ml) | Hylene W(5.3g) | 20 ml | 2.1g |
| 11 | Jeffamine ED600(6g) | Isopropanol (100 ml) | Hylene W(5.3g) | 20 ml | 2.1g |

Wool fabric was treated as above with 4% of PPS No. 2. After a 6 hour Cubex wash, samples showed less than 2% area shrinkage. The light fastness (see above) was >8 and the thermal stability was >4 days at 120° C.

I claim:

1. A composition for the treatment of fibrous materials which has the average molecular formula represented by the structure (I), $$R(NHCONR'R'')_x(NHCOSO_3^-M^+)_Y \quad (I)$$

where R is an organic radical, containing at least 6 carbon atoms; R' is an alkyl or aryl radical which may or may not contain substituents; R'' is either hydrogen or an alkyl radical; $x$ and $y$ are each greater than zero and $x + y \geqq 2$; $M^+$ is a monovalent cation or one equivalent of a polyvalent cation such that there is electrical neutrality in the molecule; and the molecular weight, as represented by the formula (I), is in excess of 500.

2. A method for the preparation of the a composition as defined in claim 1, which comprises reacting a polyisocyanate component (A) which is a compound or mixture of compounds containing on average two or more isocyanate groups attached to carbon atoms, simultaneously or successively with the following components:

A. a compound or mixture of compounds containing on average one or more primary and/or secondary amino groups per molecule;

B. an aqueous solution containing one or more types of ions selected from metabisulphite, bisulphite and sulphite;

C. 75% or more by weight, based on the total mixture, of one or more water-miscible aliphatic solvents containing alcohol and/or ether groups, the proportions of components A, B and C being chosen such that for each mole of isocyanate groups in A there is a total in B and C of at least one mole of amino groups and bisulphite ions or their equivalents.

3. A method as claimed in claim 2, wherein the proportions of component D and water in component C are such that the product formed in the overall reaction contains more than 10% solids by weight.

4. A method as claimed in claim 3, wherein the proportion of component D and water are such that the product contains more than 20% solids by weight.

5. A method as claimed in claim 2, wherein component A is dissolved in solvent D and immediately or after a short delay one of the following alternative steps is performed:

1. a mixture of components B and C is added; or
2. components B and C are added simultaneously; or
3. component B is added, followed by component C;

or 4. component C is added, followed by component B; the component B being added as such or in a solution in or organic solvent.

6. A method as claimed in claim 5, wherein the various steps are performed at a temperature in the range 0° to 40° C.

7. A method as claimed in claim 6, wherein the temperature is in the range of 0° to 20° C.

8. A method as claimed in claim 2, wherein the polyisocyanate component (A) is selected from the class consisting of:

diisocyanates of structure $$OCN-(CH_2)_n-NCO$$

where $n$ is an integer from 2 to 16, 1-isocyanato-3-isocyanatomethyl-3,5,5-trimethylcyclohexane, trimethylhexamethylene diisocyanate, 2-methoxycarbonyl-pentamethylene-diisocyanate, the isomeric diisocyanato-benzenes, xylenes, naphthalenes, chlorobenzenes and bromobenzenes, the isomeric bisisocyanatomethyl-benzenes, diisocyanato-toluenes, the isomeric bis-(isocyanato) and bis-(isocyanato-methyl)-cyclohexanes and methyl-cyclohexanes, the isomeric bis-(isocyanatocyclohexyl)methanes, diphenyl methane-4,4'diisocyanate, dianisidine diisocyanate, diphenylene diisocyanate, bitolylene diisocyanate, and the commercial product DDI which is a $C_{36}$-diisocyanate; triphenyl methane-4,4',4''-trisocyanate, polymethylene polyphenylisocyanates, and products containing isocyanate rings arising from the trimerisation of aromatic diisocyanates.

9. A method as claimed in claim 2, wherein the isocyanate component (A) is a higher molecular weight and/or functionality polyisocyanates prepared by the reaction of one or more diisocyanates of structure $$OCN\text{-}(CH_2)_n\text{-}NCO$$

Where $n$ is an integer from 2 to 16, 1-isocyanate-3-isocyanatomethyl-3,5,5-trimethylcyclohexane, trimethylexamethylene diisocyanate, 2-methoxycarbonyl-pentamethylene-diisocyanate, the isomeric diisocyanato-benzenes, xylenes, naphthalenes, chlorobenzes and bromobenzenes, the isomeric bisisocyanatomethyl-benzenes, diisocyanate-toluenes, the isomeric bis-(isocyanato) and bis-(isocyanatomethyl)-cyclohexanes and methyl-cyclohexanes, the isomeric bis-(isocyanatocyclohexyl)-methanes, diphenyl methane-4,4'diisocyanate, dianisidine diisocyanate, diphenylene diisocyanate, bitolylene diisocyanate, and the commercial product DDI which is a $C_{36}$-diisocyanate with one or more polyols selected from the class consisting of: polyols derived from the polymerisation of cyclic ethers: polycaprolactone polyols, hydroxyl terminated polybutadiene, butadiene-styrene, or butadiene-acrylonitrile copolymers, caster oil and other glycerides of hydroxyacids, polymerised castor oils, the reaction products of ethylene oxide or propylene oxide and castor oil, polyols with a polyester backbone obtained from the reaction of dicarboxylic acids with a slight excess of a diol; glycerol, trimethylolpropane, trimethylol ethane, pentaerythritol and dipentaerythritol.

10. A method as claimed in claim 2, wherein the amino component (B) comprises one or more compounds (B) having one or more amino groups of the type $R^8NH_2$ or $R^9R^{10}NH$ where $R^9$ is an organic radical and $R^{10}$ is either an organic or inorganic radical.

11. A method as claimed in claim 10, wherein the amino component (B) comprises one or more compounds selected from the class consisting of:

primary and secondary aliphatic amines;

primary and secondary aromatic or heteroaromatic amines;

hydroxylamines of the type $R'ONH_2$, HO-NHR' and R'ONHR'', mono, di and tri-substituted hydrazines, N-chloroamines, N-substituted sulphamic acids and N-substituted hydroxylamine-O-sulphonic acids;

compounds containing two or more primary and/or secondary aliphatic amino groups;

diamines of the type $R''NHCH_2CH_2CH_2NH_2$ where $R^{11}$ is an organic radical which are prepared from primary amines by reaction with acrylonitrile, followed by reduction of the resultant nitrile; aromatic diamines;

amino terminated polyethers.

12. A method as claimed in claim 2, wherein the component (C) is a solution prepared by dissolving in water alkali metal and/or ammonium bisulphites and/or metabisulphites, or by passing sulphur dioxide into aqueous solutions of alkali metal or ammonium hydroxides or by acidifying solutions of sulphite salts.

13. A method as claimed in claim 2, wherein the component (D) is selected from the following class: methanol, ethanol, n-propanol, iso-propanol, the isomeric butanols, tetrahydrofurfuryl alcohol, 2-methoxyethanol, and 2-ethoxyethanol, dioxan, tetrahydrofuran, ethylene glycol dimethyl ether, ethylene glycol diethyl ether, diethylene glycol dimethyl ether, and diethylene glycol diethyl ether.

14. A method as claimed in claim 13, wherein the component (D) additionally contains water and water-miscible solvent, or a water-immiscible solvent.

15. Compositions as claimed in claim 1, whenever made by the method of claim 2.

16. A process for improving the properties of a fibrous material which comprises applying to the material a composition as claimed in claim 1, and curing the composition on the material.

17. Fibrous materials whenever treated by the process claimed in claim 16.

* * * * *